US007986231B1

(12) United States Patent
Bentley et al.

(10) Patent No.: US 7,986,231 B1
(45) Date of Patent: Jul. 26, 2011

(54) ACOUSTIC SENSOR NETWORK

(75) Inventors: Jon Bentley, New Providence, NJ (US); Anjur Sundaresan Krishnakumar, Princeton, NJ (US); David Weiss, Long Valley, NJ (US)

(73) Assignee: Avaya Inc., Basking Ridge, NJ (US)

( * ) Notice: Subject to any disclaimer, the term of this patent is extended or adjusted under 35 U.S.C. 154(b) by 272 days.

(21) Appl. No.: 12/211,474

(22) Filed: Sep. 16, 2008

(51) Int. Cl.
*G08B 21/00* (2006.01)

(52) U.S. Cl. ..... 340/540; 340/541; 340/565; 381/56

(58) Field of Classification Search ..... 340/540, 340/541, 550, 555, 545.2; 702/14, 36, 51, 702/54; 381/58, 59, 95, 56; 348/143, 155; 73/592, 40.5 A
See application file for complete search history.

(56) References Cited

U.S. PATENT DOCUMENTS

| | | | | |
|---|---|---|---|---|
| 5,598,456 | A | 1/1997 | Feinberg | |
| 6,529,128 | B2 | 3/2003 | Weng | |
| 6,738,456 | B2 | 5/2004 | Wrona et al. | |
| 6,762,686 | B1 | 7/2004 | Tabe | |
| 7,366,674 | B2 | 4/2008 | Dione | |
| 7,403,116 | B2 * | 7/2008 | Bittner | 340/540 |
| 7,627,138 | B2 * | 12/2009 | Julia et al. | 382/103 |
| 2002/0126009 | A1 * | 9/2002 | Oyagi et al. | 340/541 |
| 2004/0233983 | A1 * | 11/2004 | Crawford et al. | 375/240.01 |
| 2005/0146606 | A1 * | 7/2005 | Karsenty et al. | 348/143 |
| 2005/0197097 | A1 | 9/2005 | Mohler | |
| 2005/0244014 | A1 | 11/2005 | Elko et al. | |
| 2008/0258924 | A1 * | 10/2008 | Moss | 340/577 |
| 2009/0243852 | A1 * | 10/2009 | Haupt et al. | 340/541 |

FOREIGN PATENT DOCUMENTS

EP 0454421 10/1991

OTHER PUBLICATIONS

Cisco and Johnson Controls, "Building Automation System over IP (BAS/IP) Design and Implementation Guide—Cisco Validated Design," Aug. 15, 2008, v8.1, 107 pages, San Jose, California.

* cited by examiner

*Primary Examiner* — Toan N Pham

(57) ABSTRACT

Each one of a plurality of communication devices that are located at different physical locations contains an acoustic sensor for monitoring the physical location of its communication device, and reports acoustic events detected by its acoustic sensor to a manager. The manager displays a map which shows the physical locations, the events detected by the acoustic sensor in each communication device, sent notification messages, and received response messages.

34 Claims, 6 Drawing Sheets

ACOUSTIC SENSOR NETWORK

TECHNICAL FIELD

The system and method relates to sensor networks and in particular to acoustic sensor networks.

BACKGROUND

Typically, alarm systems and telephone systems have been separate systems. The alarm/security systems usually have separate wiring, monitoring, and control systems. Many existing telephony systems utilize telephones that have the components necessary (e.g., a microphone and speaker (acoustic sensor)) to provide the same functionality as existing alarm/security systems. However, most alarm/security systems fail to utilize the existing telephone infrastructure. In addition, current systems fail to utilize all of the capabilities of acoustic sensors. Existing systems fail to fully integrate and display notification messages to occupants and the occupants' responses in relation to a physical location.

For example, U.S. Pat. No. 6,529,128 discloses a separate alarm system in which occupants in an area can go to a route indicator. The route indicator provides escape route instructions to building occupants. The escape route is determined based on input from sensors. The problem with this system is that it is separate from existing telecommunications systems, it is not interactive with occupants, it fails to use acoustic sensors, and it fails to use physical maps to display interactive information to aid potential emergency responders.

Other systems, such as disclosed in U.S. Pat. No. 7,366,674, use a hierarchical map for displaying the status of occupants of a building. The system allows occupants to provide location status during emergency conditions. However, this system fails to leverage existing telecommunications system's acoustic sensors and does not provide an integrated solution for displaying status, notifications, and responses on a physical map.

Patent Application Publication 2005/0244014 discloses using an acoustic sensor in a telephone. This system also discloses sending a notification to a user and receiving a response from the user. However, the system does not disclose an integrated solution for displaying status, notification, and responses on a map. Moreover, the system does not disclose utilizing additional capabilities of acoustic sensors to monitor for events in addition to temperature.

SUMMARY

The system and method are directed to solving these and other problems and disadvantages of the prior art. The system and method comprises a plurality of communication devices that are located in different physical locations. Each device contains an acoustic sensor for monitoring the physical locations of the communication device. Each communication device reports acoustic sensor events by monitoring its acoustic sensor. The events are sent to a manager. The manager displays a map which shows the physical locations, the events from the acoustic sensor in each communication device, sent notification messages, and received response messages.

BRIEF DESCRIPTION OF THE DRAWING

These and other features and advantages of the system and method will become more apparent from considering the following description of an illustrative embodiment of the system and method together with the drawing, in which.

DETAILED DESCRIPTION

Figure 1:
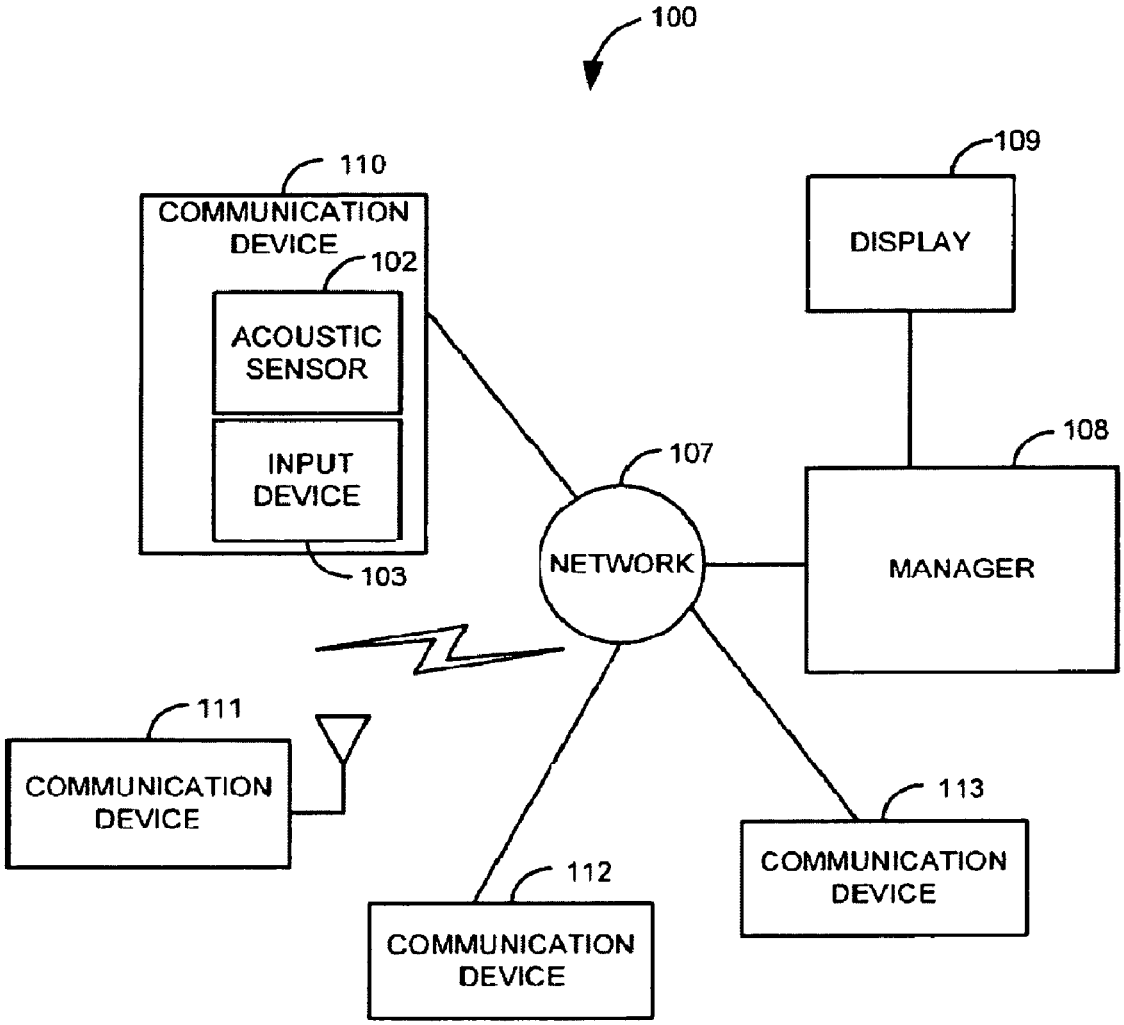
FIG. 1 is a block diagram illustrating an acoustic sensor network.

FIG. 1 is a block diagram illustrating an acoustic sensor network 100. The acoustic sensor network 100 comprises a plurality of communication devices 110-113, a network 107, a manager 108, and a display 109. Communication device 110 contains an acoustic sensor 102 and an input device 103. Communication devices 111-113 also contain an acoustic sensor and input device (not shown). Communication devices 111-113 are shown to illustrate a plurality of communication devices in an acoustic sensor network 100. Communication devices 110, 112, and 113 connect to network 107 via a wired connection. Communication device 111 connects to the network 107 via a wireless connection. The manager 108 connects to the network via a wired connection. Display 109 connects to the manager 108.

Communication devices 110-113 could be any device capable of sending and receiving data, such as a telephone, a cellular telephone, a Personal Digital Assistant (PDA), a Personal Computer (PC), and the like. The acoustic sensor 102 could be any device capable of sending and receiving acoustic signals, such as the combination of a microphone and speaker. The input device 103 could be any device capable of receiving input, such as a key pad, a keyboard, a touch screen, a microphone, and the like. The input device 103 could be a microphone in the acoustic sensor 102. An occupant is any user of the communication device 110-113. In addition, an occupant could be a visitor to the location acoustically monitored by the acoustic sensor 102. The manager 108 could be any device capable of sending and receiving messages, such as a PC, a Private Branch eXchange (PBX), a router, a Session Initiation Protocol (SIP) proxy server, and the like. The manager 108 could comprise multiple devices. The display 109 could be any device capable of displaying images, such as a PC, a telephone, a PDA, a Cathode Ray Tube (CRT), a Liquid Crystal Display (LCD), and the like. The display 109 could be a remote display using a wireless connection.

The network 107 could be any type of network, such as a wired network, a wireless network, a fiber optic network, and the like. Communications devices 110-113 may communicate with the manager 108 via the network 107 or may be hardwired directly to the manager 108. The communication devices 110-113 can communicate with the manager 108 by using a variety of protocols, such as Internet Protocol (IP), Asynchronous Transfer Protocol (ATM), Time Division Multiplexed (TDM), SIP, 802.11G, and the like.

The communication devices 110-113 are located at different physical locations. The acoustic sensor 102 monitors the physical location around communication device 110 to detect events. The acoustic sensor 102 in communication device 110 can monitor a physical location in a variety of ways to detect an event. For example, the event of temperature monitoring is accomplished by an acoustic sensor as disclosed in U.S. Patent Application Publication 2005/0244014, which is hereby incorporated by reference. The acoustic sensor 102 can monitor for other events, such as a gunshot, the sound of a person, an explosion, an impact (e.g. a car hitting a building), the sound of fire, and the like. Communication device 110 reports the events of the acoustic monitoring to the manager 108. Communication devices 111-113 also monitor their corresponding physical locations and report the events of the acoustic monitoring to the manager 108.

The manager 108 receives the reports of the acoustic monitoring from the communication devices 110-113. Based on the reports of the acoustic monitoring, the manager 108 determines if a first notification message needs to be sent to at least one and/or all of the communication devices 110-113. If it is determined that the first notification message needs to be sent, the first notification message is sent to at least one and/or all of the communication devices 110-113. The manager 108 displays a map 200 in display 109 that contains at least one and/or all of the events of the acoustic monitoring. If the first notification message was sent to one or more of the communication devices 110-113, the manager 108 updates the map 200 in the display 109 to show the notification message(s).

In response to the first notification, one or more of the communication devices 110-113 send a response message containing an occupant status to the manager 108. The response message could be based on the occupant entering information via the input device 103. For example, the occupant could speak a command into a microphone, input a command into a keypad, and/or input a command on a touch screen. The manager 108 updates the map 200 in the display 109 to show the received response message(s) from communication devices 110-113 in conjunction with the locations 201-204. Based on the received response message(s), the manager 108 sends a second notification message to one or more of the communication devices 110-113. The manager 108 updates the map 200 in the display 109 with a second notification message(s) in conjunction with the locations 201-204. The manager 108 can archive the events and notification messages. In addition, the manager 108 could send the map to a remote display (not shown) such as a remote display at fire station and the like.

Figure 2:
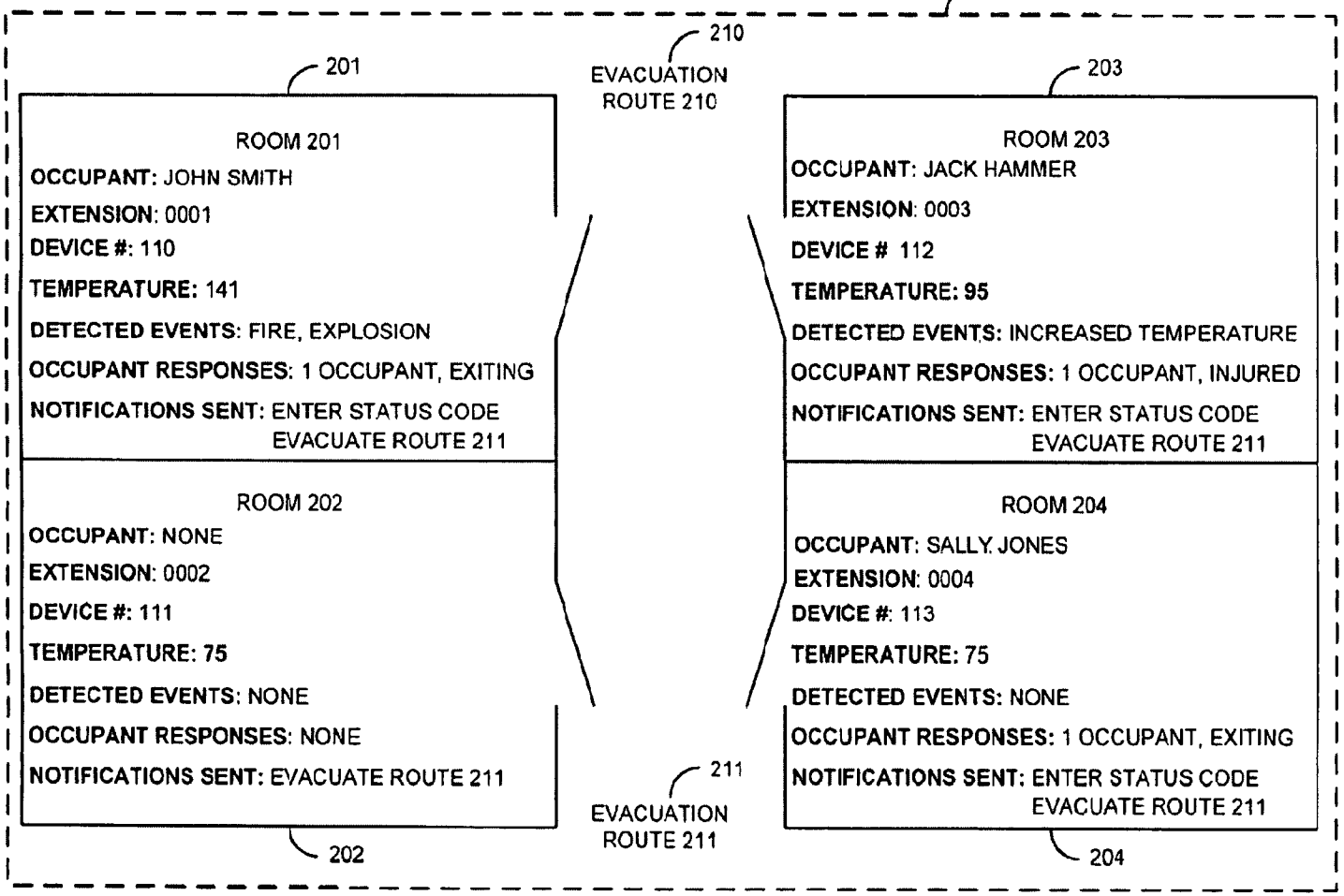
FIG. 2 is a diagram illustrating a map showing a physical location in relation to a plurality of communication devices in an acoustic network.

FIG. 2 is a diagram illustrating a map 200 showing the physical locations comprising rooms 201-204 in relation to a plurality of communication devices 110-113 in an acoustic sensor network 100. In map 200, each room 201-204 has associated information such as: the occupant name, a telephone extension number, the device number, a temperature, detected events, occupant responses, and notifications sent. Other information could be displayed based on implementation.

Each of the rooms 201-204 has an associated communication device 110-113. In this example, communication device 110 is in room 201, communication device 111 is in room 202, communication device 112 is in room 203, and communication device 113 is in room 204. The communication device numbers 110-113 are shown on the map for each room 201-204.

The acoustic sensor 102 in communication device 110 monitors room 201. Likewise, the acoustic sensors in communication devices 111-113 monitor their respective rooms 202-204. The acoustic sensor 102 in communication device 110 has detected a temperature event of 141°, a fire event, and an explosion event in room 201. The acoustic sensor in communication device 111 has detected a temperature event of 75° in room 202. The acoustic sensor in communication device 112 has detected a temperature event of 95°, which is an increase over the prior temperature in room 203. The increase in temperature causes the acoustic sensor in communication device 112 to generate an increase in temperature event. The acoustic sensor in communication device 113 has detected a temperature event of 75° in room 204.

The events from the acoustic sensors in communication devices 110-112 are reported to the manager 108. The manager 108 updates map 200 to indicate a temperature of 141°, detection of a fire, and detection of an explosion in room 201. The manager 108 updates the map 200 to indicate the temperature of 75° in room 202. The manager 108 updates the map 200 to indicate a temperature of 95° and an event of increased temperature in room 203. The manager updates the map 200 to indicate a temperature of 75° in room 204.

Based on the events of a temperature of 141° in room 201, a fire in room 201, an explosion in room 201, and an increased temperature in room 203, the manager 108 sends notification messages containing occupant instructions to communication devices 110-113 indicating that the occupants of rooms 201-204 should evacuate using evacuation route 211. This is because evacuation route 210 is likely blocked due to a fire in room 201 which is next to evacuation route 210. The communication devices 110-113 notify the occupants of each of the rooms 201-204 to use evacuation route 211. Communication devices 110-113 can notify the occupants in various ways, such as: an audio message (e.g. specialized ring tone such as saying "alert"), a video message, a vibration, calling a cell phone, and/or any combination of these.

The manager 108 updates the map 200 in display 109 for each of the rooms 201-204 to indicate that a notification message telling the occupants to use evacuation route 211 was sent to communication devices 110-113. A notification message could also be sent to an emergency response center (e.g. 911 dispatch or a corporate resource). In addition, a second notification message with occupant instructions requesting that the occupant enter a status code is sent to communication devices 110, 112, and 113. The second notification message is not sent to communication device 111 in room 202 because room 202 does not have an occupant. Examples of a status code could be entering a number followed by the # key to indicate how many occupants are in a room 201-204 on a keypad (103). Other status codes could be entering *7 to indicate you are exiting or *8 to indicate you are injured and cannot evacuate. An individual response or combinations of responses can be entered by an occupant in response to a notification message.

In this example, John Smith responded that he is in room 201 and that he is exiting. Likewise, Sally Jones has indicated that she is in room 204 and is exiting. Jack Hammer has indicated that he is in Room 203. However, Jack Hammer has responded that he is injured and has not evacuated. The manager 108 then updates the map 200 in display 109 to indicate the response of each of the occupants in rooms 201, 203, and 204.

The flow of notification and response messages could happen in various orders. For example, a first notification message containing occupant instructions could be sent to devices 110-113 asking the occupant(s) to indicate how many people are in each of the rooms 201-204. The occupant(s) then respond and the manager 108 receives the response(s) which contain the occupant status. The manager 108 then sends a notification message containing occupant instructions to communication devices 110-113 to indicate that the occupants should use evacuation route 211.

The types of events that could be displayed and/or monitored may vary from those described above. For example, the acoustic sensor 102 could detect the event of a decrease in temperature. This could indicate that a window is broken or that a thermostat is broken in a room. Another event could be emergency responders shouting "clear" when they have determined that there are no occupants in a room. Another event could a communication device 110-113 failing to respond to a poll. This could indicate that the device has been damaged due to a fire or perhaps an impact to the building that has destroyed the communication device 110-113. Other events could include recognizing a voice, the breaking of a window, a movement detected by an accelerometer (e.g. an earthquake), and a sound of wind.

Figure 3:
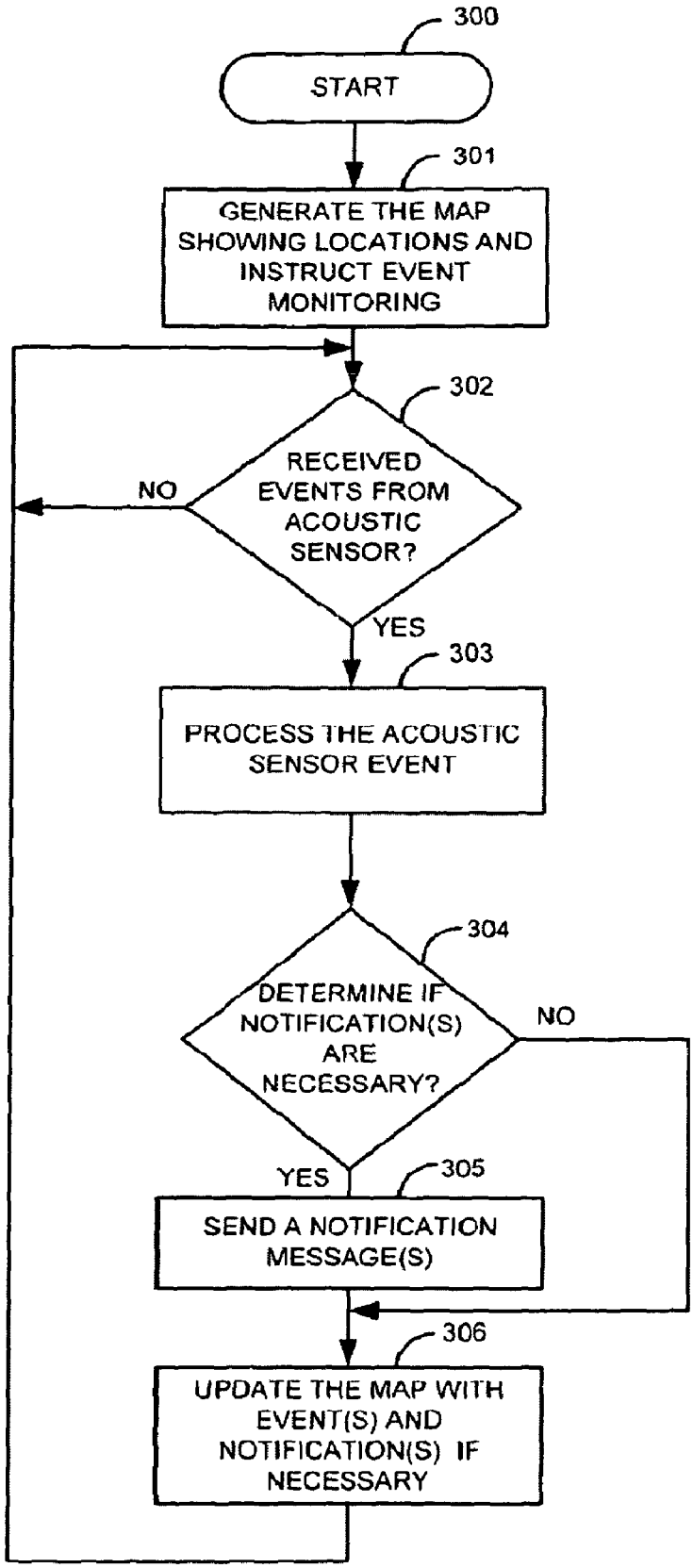
FIG. 3 is a method for generating and updating a map that shows physical locations of communication devices in an acoustic network.

FIG. 3 is method for generating and updating a map 200 that shows physical locations 201-204 of communication devices 110-113 in an acoustic sensor network 100. Illustratively, the manager 108 and communication devices 110-113 are implemented as stored-program-controlled entities, such as a computer, which perform the method of FIGS. 3-6 by executing a program stored in a storage medium, such as a memory or disk. The process starts 300 by generating 301 the map 200 that shows the physical locations (rooms 201-204) of communication devices 110-113 in display 109, and by instructing the communication devices 110-113 to monitor for one or more events. The acoustic sensor 102 monitors room 201 for the one or more events. Likewise, the acoustic sensors in communication devices 111-113 monitor rooms 202-204 for the one or more events. Communication devices 110-113 report the events of the monitoring to the manager 108.

The manager 108 waits to receive 302 the reported events from one or more of the communication devices 110-113. If no reported events are received 302, the manager 108 waits to receive 302 the reported events. If the manager 108 receives 302 reported events from acoustic sensor 102, the manager 108 processes 303 the reported event(s) to determine 304 if a notification message based on location should be sent. If the manager 108 determines 304 that a notification message is not necessary, the process goes to step 306. Otherwise, if the manager 108 determines 304 that a notification message is necessary, the manager 108 sends 305 a notification message that may contain occupant instructions to at least one of the plurality of communication devices 110-113. The manager 108 updates 306 the map 200 with at least one of the events and at least one of the notification messages in conjunction with the locations (rooms 201-202). The manager 108 then waits to receive 302 a reported event from communication devices 110-113.

Figure 4:
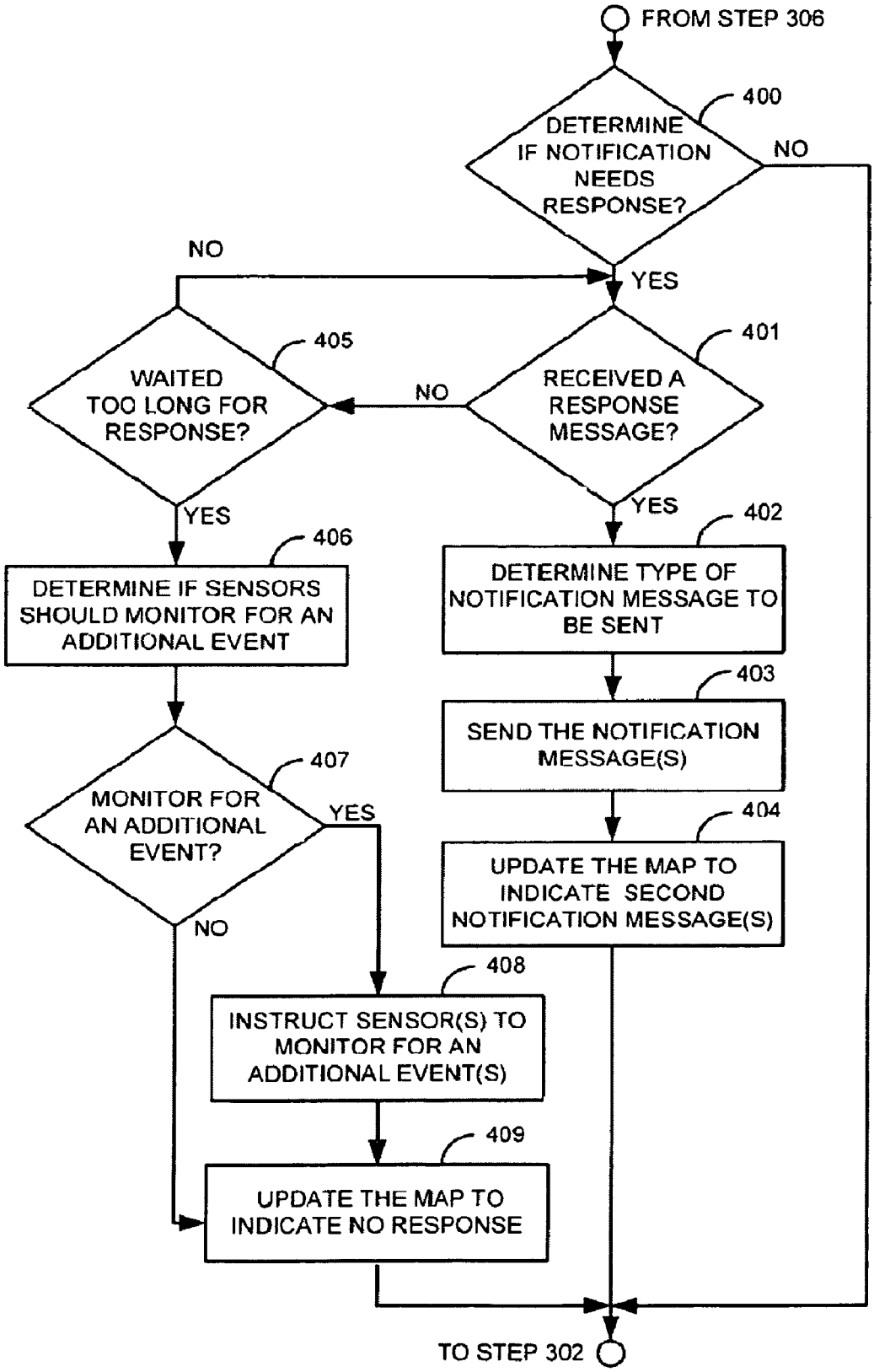
FIG. 4 is a method for displaying notification and response messages in a map that show physical locations of communication devices in an acoustic network.

FIG. 4 is method for displaying notification and response messages in a map 200 that shows physical locations (rooms 201-204) of communication devices 110-113 in an acoustic sensor network 100. FIG. 4 is a flow diagram that is inserted between steps 306 and 302 in FIG. 3. After updating 306 the map 200 with event(s) and the notification message if necessary, the manager 108 determines 400 if a notification message was sent that requires a response message. If no response message is necessary or no notification message was sent, the process goes to step 302 in FIG. 3. Otherwise, the process goes to step 401.

In response to the sending 305 of the notification message to one or more of the communication devices 110-113, the manager 108 waits to receive 401 a response message from one or more of the communication devices 110-113. If no response message is received, the manager 108 determines 405 if the manager 108 has waited too long without receiving a response from one or more of the communication devices 110-113. If the manager 108 determines 405 that the manager 108 has waited too long, the process goes to step 406. Otherwise, if the manager 108 determines 405 that the manager 108 has not waited too long, the process waits to receive 401 a response message from one or more of the communication devices 110-113.

The manager 108, after receiving 401 a response message, optionally determines 402 what type of notification message will be sent. For example, if the response message from step 401 indicates that the occupant is injured, the notification message sent in step 403 could tell the occupant that an emergency responder will be there in five minutes. If the response message received in step 401 indicates that the occupant is not injured, the notification message sent in step 403 informs the occupant to evacuate using a specific route. The manager 108 sends 403 the notification message to the appropriate communication device(s) 110-113. The manager 108 updates 404 the map 200 in the display 109 with the notification message. The process then goes to step 302 in FIG. 3.

If the manager 108 determines 405 that it has waited too long and has not received a response message, the manager 108 determines 406 if the acoustic sensor 102 should monitor for an additional event. For example, the manager 108 could determine that the acoustic sensor 102 in communication device 110 should listen for someone talking. If the acoustic sensor 102 needs to monitor 407 for an additional event, the manager 108 instructs 408 the acoustic sensor 102 in communication device 110 to monitor for an additional event. The manager 108 updates 409 the map 200 in display 109 to indicate that no response message was received. The process then goes to step 302 in FIG. 3. Otherwise, if the acoustic sensor 102 does not need to monitor 407 for an additional event, the process updates 409 the map 200 in display 109 to indicate that no response was received. The process then goes to step 302 in FIG. 3.

Figure 5:
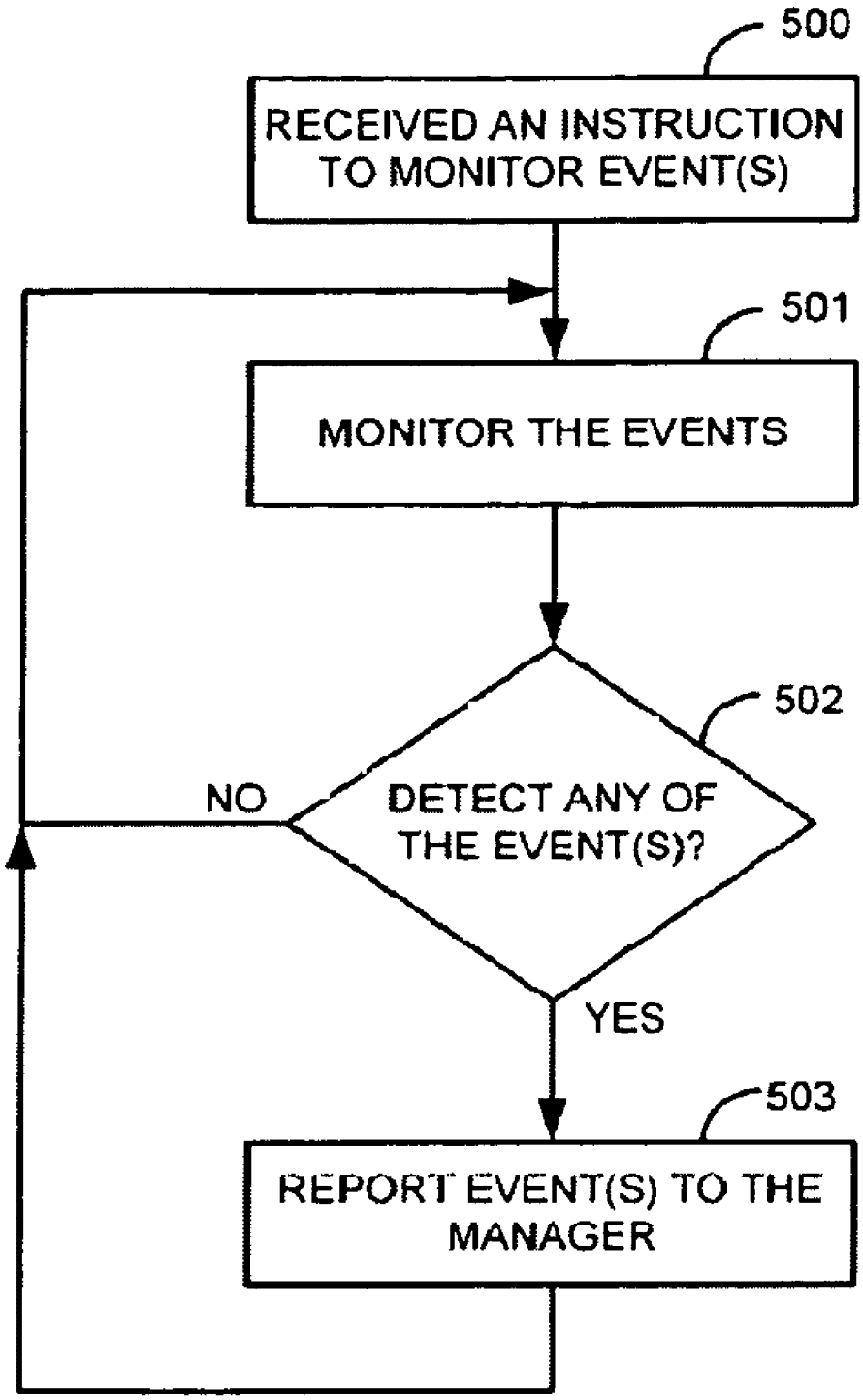
FIG. 5 is a method for monitoring and reporting acoustic events in a communication device.

FIG. 5 is a method for monitoring and reporting acoustic events in a communication device 110-113. The process begins when a communication device 110-113 receives 500 an instruction to monitor one or more events. The instruction could be an initial instruction (step 301) to monitor events such as temperature, a change in temperature, a gunshot, an explosion, a fire, and the like. The instruction could be to monitor for an additional event (step 408) such as listening for voice sounds if the occupant is not responding to notification messages. Another option would be where there is a default set of events that the communication device 110-113 monitors without receiving an instruction. Upon receiving 500 the instruction, the acoustic sensor in the communication device (s) 110-113 monitors 501 for event(s). If the acoustic sensor in the communication device(s) 110-113 does not detect 502 any of the events, the acoustic sensor in the communication device 110-113 monitors 501 for the event(s). When the acoustic sensor in the communication device 110-113 detects 502 one or more of the monitored events, the communication device 110-113 reports 503 the event(s) to the manager 108.

Figure 6:
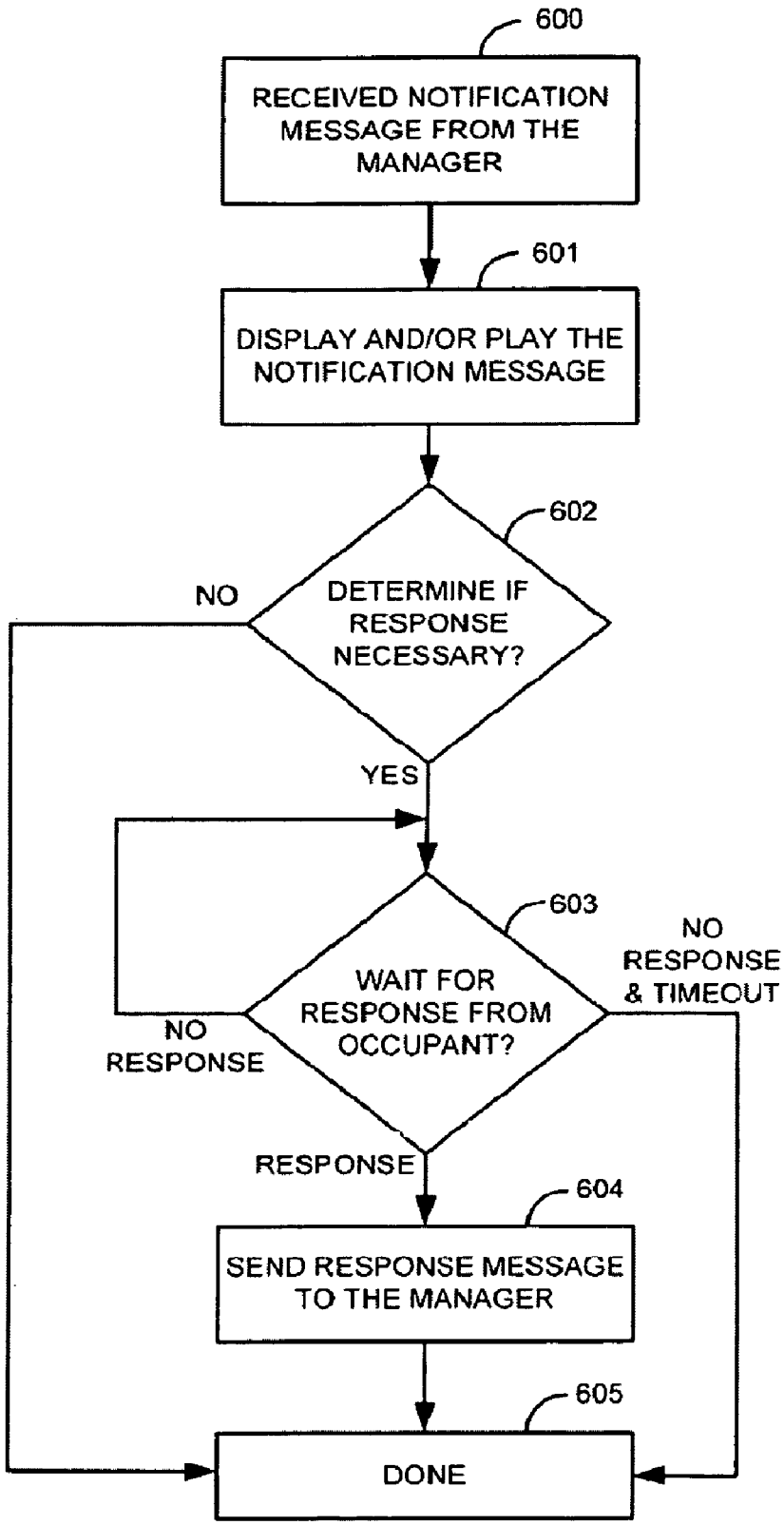
FIG. 6 is a method for receiving notification messages and sending response messages in a communication device.

FIG. 6 is a method for receiving notification messages and sending response messages in a communication device 110-113. The flows in FIG. 6 are given sequentially, but standard techniques could be employed to handle concurrency (e.g. queues, priorities, and the like). The process begins when the communication device 110-113 receives 600 a notification message from the manager 108. The communication device 110-113 displays and/or plays 601 the notification message. The communication device 110-113 determines 602 if a response is necessary. If a response is not necessary, the process is done 605.

Otherwise, if the communication device 110-113 determines 602 that a response is necessary, the communication device 110-113 waits 603 for a response from the occupant.

The communication device 110-113 waits 603 until either there is a response from the occupant, or there is a timeout and no response. If there is a timeout before receiving a response from the occupant, the process is done 605. Otherwise, if there is a response from the occupant, the communication device 110-113 sends 604 a response message to the manager 108 and the process is done 605. The response message may include a response from the occupant.

Consider the following example of a process using the combined methods of FIGS. 3-6 and the map 200 in FIG. 2. The manager 108 instructs 301 the communication devices 110-113 to monitor for temperature events, change of temperature events, explosion events, gunshot events, and fire events. The manager 108 then waits to receive 302 a report of the events from the communication devices 110-113. The communication devices 110-113 receive 500 the instructions to monitor the events from step 301. The acoustic sensors in communication devices 110-113 monitor 501 for the events. The acoustic sensor 102 in communication device 110 detects 502 a temperature event of 75°. The detection 502 of the temperature event could be accomplished by periodically checking the temperature. The communication device 110 reports 503 the temperature event of 75° to the manager 108.

The manager 108 receives 302 a report from the acoustic sensor 102 in communication device 110 of a temperature event of 75°. The manager 108 processes 303 the temperature event of 75° and determines 304 that a sending a notification message is not necessary. The manager 108 updates 306 the map 200 in room 201 to indicate a temperature of 75°. The manager 108 determines 400 that since no notification was sent, the manager 108 does not need to wait for a response from communication device 110. The process goes to step 302.

The acoustic sensor 102 in communication device 110 detects 502 a gunshot event in room 201. Communication device 110 reports 503 the gunshot event to the manager 108. The manager 108 receives 302 the gunshot event from communication device 110. The manager 108 process 303 the gunshot event and determines 304 that a notification message containing occupant instructions should be sent to communication device 113. A notification message requesting the occupant (Sally Jones) in room 204 to identify the number of occupants in room 204 is sent 305 to communication device 113. The manager 108 updates 306 the map 200 with the gunshot event in room 201, and the notification message which indicates the number of occupants in room 204.

The manager 108 determines 400 that the notification message sent in step 306 to communication device 113 requires a response message. The manager waits (401, 405) for a response message from communication device 113. Communication device 113 receives 600 the notification message from step 305. Communication device 113 alerts Sally Jones by displaying and/or playing 601 the notification message. Communication device 113 determines 602 that a response is necessary. Communication device 113 instructs Sally Jones to enter a number indicating the number of occupants followed by the # key. Sally Jones enters 1#. After waiting 603 for the response, communication device 113 sends 604 a response message to the manager 108 indicating that there is a single occupant in room 201.

The manager 108 receives 401 the response message sent in step 604 containing the occupant status from communication device 113. The manager 108 determines 402 that a second notification message should be sent 403 based on the fact that a gunshot was detected in room 201. A second notification message containing occupant instructions indicating that Sally Jones should lock the door and hide under the desk is sent 403 to communication device 113. The manager 108 updates the map 200 to show the notification message requesting the occupant to lock the door and hide under the desk.

Communication device 113 receives 600 the second notification message sent in step 403 from the manager 108. Communication device 113 displays and/or plays 601 the notification message. Communication device 113 determines 602 that no response is necessary and the process is done 605.

In the above example, if Sally Jones did not respond (no response and timeout 603) and the manager 108 determined 405 that it had waited long enough for a response, the manager 108 determines 406 that the acoustic sensor in communication device 113 should monitor 407 for a specific event. The manager 108 instructs 408 the acoustic sensor in communication device 113 to acoustically monitor for the additional event of someone talking. The manager 108 updates 409 the map 200 in room 204 to indicate that no response was received to the notification message requesting Sally Jones to enter the number of occupants in room 204. The process goes to step 302 and the manager 108 waits to receive 302 event(s) from the acoustic sensor in communication device 113.

Communication device 113 receives 500 the instruction from step 408 to monitor the additional event of detecting someone talking. The acoustic sensor in communication device 113 monitors 501 the event of someone talking. The acoustic sensor in communication device 113 detects 502 the event of someone talking in room 204. Communication device 113 reports 503 the event of someone talking in room 204 to the manager 108. The manager 108 receives 302 the reported event of someone talking from communication device 113. The manager 108 processes 303 the event of detecting someone talking and determines 304 that a notification is not necessary. The manager 108 updates 306 the map 200 to indicate the event of hearing someone talking in room 204.

At this point, emergency responders know that there has been a gunshot detected in room 201. They also know that there is someone in room 204 who did not respond to the initial notification message. This could indicate that the person in room 204 is injured and cannot respond to the notification message. This allows emergency responders to assess the situation and respond in an informed manner.

Of course, various changes and modifications to the illustrative embodiment described above will be apparent to those skilled in the art. For example, the sound of events could be recorded for playback and/or event notifications could be sent to key people in the enterprise. These changes and modifications can be made without departing from the spirit and the scope of the system and method and without diminishing its attendant advantages. It is therefore intended that such changes and modifications be covered by the following claims except insofar as limited by the prior art.

What is claimed is:

1. A system for managing acoustic events comprising:

a. a manager adapted to respond to reporting of a plurality of communication devices located at different physical locations, each acoustically monitoring its physical location and reporting at least one event detected by the monitoring, and for sending notification messages to selected ones of the devices; and b. a display adapted to display a map showing the physical locations, and for displaying on the map at least one of the events and at least one of the notification messages in conjunction with the locations.

2. The system of claim 1, wherein the manager is adapted to receive a response message from a selected one of the devices in response to the one of the notification messages.

3. The system of claim 2, wherein the manager is adapted to select one of a plurality of different types of notification messages and to send the notification message of the selected type.

4. The system of claim 2, wherein the response message is based on at least one item selected from a group comprising: an audio signal, an occupant input from a keypad, and an occupant input from a touch screen.

5. The system of claim 2, wherein the manager is adapted to display the response message on the map in conjunction with the locations.

6. The system of claim 2, wherein the manager is adapted to respond to the response message by sending a second one of the notification messages to the selected one of the devices.

7. The system of claim 6, wherein the manager is adapted to display the second one of the notification messages on the map in conjunction with the locations.

8. The system of claim 6, wherein the one of the notification messages contains occupant instructions.

9. The system of claim 6, wherein the response message contains an occupant status.

10. The system of claim 6, wherein the second one of the notification messages contains an evacuation route.

11. The system of claim 1, wherein the one of the notification messages contains an evacuation route selected by the manager based on a location of at least one of the events; and wherein at least one of the selected ones of the devices is a cellular telephone.

12. The system of claim 1, wherein the manager is adapted to respond to not receiving a response message by instructing one of the devices to monitor for an additional event.

13. The system of claim 12, wherein the manager is adapted to respond to detection of the additional event by the one of the devices by sending a second notification message.

14. The system of claim 1, wherein the event is an item selected from a group comprising: a temperature, a change in temperature, a gunshot, a sound, an explosion, an impact, a fire, a voice recognition, breaking of a window, an accelerometer detecting movement, a sound of wind, and a lack of a response from a communication device.

15. A method for managing acoustic events comprising:

a. acoustically monitoring a physical location of each of a plurality of communication devices;
b. reporting one or more events detected by the monitoring;
c. responding to the reporting by sending at least one notification message to at least one of the devices;
d. displaying a map showing the locations of the devices; and
e. displaying on the map at least one of the events and at least one of the notification messages in conjunction with the locations.

16. The method of claim 15, further comprising: responsive to the one of the notification messages, receiving a response message from a selected one of the devices.

17. The method of claim 16, further comprising the step of: selecting one of a plurality of different types of notification messages and sending the notification message of the selected type.

18. The method of claim 16, wherein the response message is based on at least one item selected from a group comprising: an audio signal, an occupant input from a keypad, and an occupant input from a touch screen.

19. The method of claim 16, further comprising the step of: displaying the response message on the map in conjunction with the locations.

20. The method of claim 16, further comprising: responsive to the response message, sending a second one of the notification messages to the selected one of the devices.

21. The method of claim 20, further comprising: displaying the second one of the notification messages on the map in conjunction with the locations.

22. The method of claim 20, wherein the one of the notification messages contains occupant instructions.

23. The method of claim 20, wherein the response message contains an occupant status.

24. The method of claim 20, wherein the second one of the notification messages contains an evacuation route.

25. The method of claim 15, wherein the one of the notification messages contains an evacuation route selected based on a location of at least one of the events; and wherein at least one of the selected ones of the devices is a cellular telephone.

26. The method of claim 15, further comprising: in response to not receiving a response message, instructing one of the devices to monitor for an additional event.

27. The method of claim 26, further comprising: in response to detecting the additional event by the acoustic sensor in one of the devices, sending a second notification message.

28. The method of claim 15, wherein the event is an item selected from a group comprising: a temperature, a change in temperature, a gunshot, a sound, an explosion, an impact, a fire, a voice recognition, breaking of a window, an accelerometer detecting movement, a sound of wind, and lack of a response from a communication device.

29. An apparatus for performing the method of one of claims 15-28.

30. An apparatus for managing acoustic events comprising:

a. means for acoustically monitoring a physical location of each of a plurality of communication devices;
b. means for reporting one or more of the events detected by the monitoring;
c. means for responding to the reporting by sending at least one notification message to at least one of the devices;
d. means for displaying a map showing the physical locations of the devices; and
e. means for displaying on the map at least one of the events and at least one of the notification messages in conjunction with the locations.

31. A method for managing acoustic events comprising:

a. acoustically monitoring a physical location of each of a plurality of communication devices;
b. reporting an event detected by the monitoring;
c. responding to the reporting by sending a first notification message to at least one of the devices;
d. displaying a map showing the locations of the devices;
e. displaying on the map the event and the first notification message in conjunction with the locations;
f. receiving a response message;
g. responsive to the response message, selecting one of a plurality of different types of notification messages;
h. sending a notification message of the selected type; and
i. displaying on the map the type of the notification message.

32. A system for managing acoustic events comprising:

a. a plurality of communication devices located at different physical locations and each comprising an acoustic sensor for acoustically monitoring the physical location of the device, each device adapted for reporting an event detected by its sensor;

b. a manager adapted to respond to the reporting, for sending notification messages to selected ones of the devices, for displaying a map showing the physical locations, and for displaying on the map the event and at least one of the notification messages in conjunction with the locations;

c. wherein the manager is adapted to respond to receipt of a response message by selecting one of a plurality of different types of notification messages, sending the notification message of the selected type, and displaying on the map the type of notification message; and d. wherein the manager is adapted to archive the event and the notification messages, and to sending the map to a remote display.

33. A method for managing acoustic events comprising:

a. acoustically monitoring a physical location of each of a plurality of communication devices;

b. reporting an event detected by the monitoring;

c. responding to the reporting by sending a first notification message to at least one of the devices;

d. displaying a map showing the locations of the devices;

e. displaying on the map the event and the first notification message in conjunction with the locations;

f. responsive to not receiving a response message, monitoring for an additional event;

g. detecting the additional event; and h. responsive to detection of the additional event, sending a second notification message.

34. A system for managing acoustic events comprising:

a. a plurality of communication devices located at different physical locations and each comprising an acoustic sensor for acoustically monitoring the physical location of the device for a first event, and for monitoring for an additional event in response to not receiving a response message, each device adapted for reporting events detected by its sensor; and b. a manager adapted to respond to the reporting, for sending notification messages to selected ones of the devices, for displaying a map showing the physical locations, for displaying on the map the event and at least one of the notification messages in conjunction with the locations, and for sending a second notification message in response to the detection of the additional event.

* * * * *